US009027363B2

(12) United States Patent
Takada et al.

(10) Patent No.: US 9,027,363 B2
(45) Date of Patent: May 12, 2015

(54) ECONOMIZER HAVING MULTIPLE LIQUID OUTLETS AND MULTIPLE FLOAT EXPANSION VALVES

(75) Inventors: Yasutaka Takada, Osaka (JP); Nobuhiro Umeda, Minneapolis, MN (US); Kenji Kinokami, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 673 days.

(21) Appl. No.: 12/865,580

(22) PCT Filed: Jan. 30, 2009

(86) PCT No.: PCT/JP2009/000365

§ 371 (c)(1),
(2), (4) Date: Jul. 30, 2010

(87) PCT Pub. No.: WO2009/096193

PCT Pub. Date: Aug. 6, 2009

(65) Prior Publication Data

US 2010/0326130 A1 Dec. 30, 2010

(30) Foreign Application Priority Data

Feb. 1, 2008 (JP) ..... 2008-023356

(51) Int. Cl.
*F25B 43/00* (2006.01)
*F25B 1/10* (2006.01)
(Continued)

(52) U.S. Cl.
CPC . *F25B 1/10* (2013.01); *F25B 1/053* (2013.01); *F25B 41/065* (2013.01); *F25B 2341/066* (2013.01); *F25B 2400/13* (2013.01); *F25B 2400/23* (2013.01)

(58) Field of Classification Search
CPC ..... F25B 1/10; F25B 41/065; F25B 1/053; F25B 2400/23; F25B 2400/13; F25B 2341/066
USPC ..... 62/510, 511, 512; 96/162, 189, 190, 96/197, 198, 239, 248
See application file for complete search history.

(56) References Cited

U.S. PATENT DOCUMENTS 2,277,647 A * 3/1942 Jones ..... 62/199
3,003,332 A * 10/1961 Watkins ..... 62/197
(Continued)

FOREIGN PATENT DOCUMENTS

JP 55-103199 A 8/1980
JP 7-332801 A 12/1995
(Continued)

*Primary Examiner* — Frantz Jules
*Assistant Examiner* — Joseph Trpisovsky
(74) *Attorney, Agent, or Firm* — Birch, Stewart, Kolasch & Birch, LLP.

(57) ABSTRACT

An economizer is provided in a multistage compression refrigeration system including a refrigerant circuit in which a multistage compressor, a condenser, a multistage expansion mechanism, and an evaporator are sequentially connected. The economizer includes: a tank having an introducing portion for introducing a refrigerant of the refrigerant circuit, a liquid outlet for guiding a liquid refrigerant into the evaporator, and a gas outlet for guiding a gas refrigerant into a medium pressure portion of the multistage compressor; and a float expansion valve, which forms part of the multistage expansion mechanism and is attached to the liquid outlet, and whose throttle amount is adjusted according to a level of the liquid refrigerant in the tank. Multiple ones of the liquid outlet and multiple ones of are provided.

2 Claims, 3 Drawing Sheets

(51) Int. Cl.

| | |
|---|---|
| ***B01D 53/02*** | (2006.01) |
| ***B01D 19/00*** | (2006.01) |
| ***B01D 53/14*** | (2006.01) |
| ***F25B 41/06*** | (2006.01) |
| *F25B 1/053* | (2006.01) |

(56) References Cited

U.S. PATENT DOCUMENTS

| | | | | | |
|---|---|---|---|---|---|
| 3,349,571 | A * | 10/1967 | Nebgen | ..... | 62/619 |
| 4,232,533 | A * | 11/1980 | Lundblad et al. | ..... | 62/509 |
| 4,551,983 | A * | 11/1985 | Atsumi et al. | ..... | 62/174 |
| 6,409,808 | B1 * | 6/2002 | Chamberlain et al. | ..... | 96/182 |
| 6,537,458 | B1 * | 3/2003 | Polderman | ..... | 210/801 |
| 2005/0044883 | A1 * | 3/2005 | Sishtla | ..... | 62/509 |

FOREIGN PATENT DOCUMENTS

| | | | | | |
|---|---|---|---|---|---|
| JP | 11-344265 | A | 12/1999 | | |
| JP | 2002-340287 | A | 11/2002 | | |
| JP | 2003-214729 | A | 7/2003 | | |
| JP | 2003-279175 | A | 10/2003 | | |
| WO | WO 03/064940 | A1 | 8/2003 | | |
| WO | WO 2007111594 | A1 * | 10/2007 | ..... | F25B 41/00 |

* cited by examiner (B)

(A)

ECONOMIZER HAVING MULTIPLE LIQUID OUTLETS AND MULTIPLE FLOAT EXPANSION VALVES

CROSS REFERENCE TO RELATED APPLICATIONS

This application is an U.S. national phase application of PCT International Application No. PCT/JP2009/000365 filed Jan. 30, 2009, which claims the benefit of Japanese Application No. 2008-023356 field Feb. 1, 2008. The entire contents of all of the above applications are hereby incorporated by reference.

TECHNICAL FIELD

The present invention relates to economizers for use in multistage compression refrigeration systems.

BACKGROUND ART

Conventionally, two-stage compression refrigeration systems, which have a refrigerant circuit in which a two-stage compressor, a condenser, a two-stage expansion device, and an evaporator are sequentially connected, have been used in the art. In order to achieve a high coefficient of performance (COP), such two-stage compression refrigeration systems use an economizer for separating a gas refrigerant from a gas-liquid two-phase refrigerant, and guiding the gas refrigerant to a medium pressure portion of the two-stage compressor (see, e.g., Patent Document 1).

An economizer shown in FIG. 2 of Patent Document 1 includes a tank having an introducing portion for introducing a refrigerant into the tank, a gas outlet for guiding a separated gas refrigerant to a two-stage compressor, and a liquid outlet for guiding a separated liquid refrigerant to an evaporator. Inside the tank is provided a float expansion valve that is attached to the liquid outlet to adjust the throttle amount according to the level of the liquid refrigerant in the tank.

CITATION LIST

Patent Document

PATENT DOCUMENT 1: Japanese Published Patent Application No. H11-344365

SUMMARY OF THE INVENTION

Technical Problem

However, conventional economizers have only one liquid outlet, and a large amount of liquid refrigerant flows out through this liquid outlet. Thus, the conventional economizers need to use a large float expansion valve, which increases the cost. This problem is serious especially in economizers for use in large capacity multistage turbo refrigeration machines, as such economizers need a larger float expansion valve due to a small differential pressure between the downstream and upstream sides of the float expansion valve.

The present invention was developed in view of the above problem, and it is an object of the present invention to provide an inexpensive economizer for use in multistage compression refrigeration systems.

Solution to the Problem

According to a first invention, an economizer is provided in a multistage compression refrigeration system (1) including a refrigerant circuit (20) in which a multistage compressor (21), a condenser (22), a multistage expansion mechanism (23, 25), and an evaporator (26) are sequentially connected. The economizer separates a gas-liquid two-phase refrigerant into a gas refrigerant and a liquid refrigerant to guide the gas refrigerant into a medium pressure portion of the multistage compressor (21), and to guide the liquid refrigerant to the evaporator (26). The economizer includes: a tank (24*a*) having an introducing portion (24*d*) for introducing the refrigerant of the refrigerant circuit (20), a liquid outlet (24*b*) for guiding the liquid refrigerant into the evaporator (26), and a gas outlet (24*c*) for guiding the gas refrigerant into the medium pressure portion of the multistage compressor (21); and a float expansion valve (25) that forms part of the multistage expansion mechanism (23, 25), and is attached to the liquid outlet (24*b*) to adjust a throttle amount according to a level of the liquid refrigerant in the tank (24*a*). Multiple ones of the liquid outlet (24*b*) and multiple ones of the float expansion valve (25) are provided.

In the first invention, the liquid refrigerant flows out of the tank (24*a*) through the multiple liquid outlets (24*b*), and the amount of the liquid refrigerant that flows out of tank (24*a*) is controlled by the multiple float expansion valves (25). This reduces the amount of control required for each float expansion valve (25), as compared to the case where the amount of the liquid refrigerant that flows out of the tank (24*a*) is controlled by one float expansion valve (25). Thus, small float expansion valves (25) can be used.

According to a second invention, in the first invention, two of the liquid outlet (24*b*) and two of the float expansion valve (25) are provided.

In the second invention, since the two liquid outlets (24*b*) are provided, the amount of the liquid refrigerant that flows out of the tank (24*a*) is controlled by the two float expansion valves (25). Thus, the amount of control required for each float expansion valve (25) is reduced by half as compared to conventional examples, whereby the float expansion valves (25) smaller than those of the conventional examples can be used.

Incidentally, the refrigerant introduced through the introducing portion (24*d*) can affect the operation of the float expansion valves (25) if it is directly sprayed onto the float expansion valves (25).

According a third invention, in the second invention, the tank (24*a*) is longer in a horizontal direction than in a vertical direction, the introducing portion (24*d*) is formed in a longitudinal central portion of the tank (24*a*), and the liquid outlets (24*b*) and the float expansion valves (25) are positioned on both sides of the introducing portion (24*d*) in a longitudinal direction of the tank (24*a*), with one liquid outlet (24*b*) and one float expansion valve (25) being located on each side.

In the third invention, the float expansion valves (25) are positioned on both sides of the introducing portion (24*d*) in the longitudinal direction of the tank (24*a*). Thus, a gap is interposed between each float expansion valve (25) and the introducing portion (24*d*).

According to a fourth invention, in the third invention, baffle plates (24*e*, 24*f*), which extend in a transverse direction of the tank (24*a*), are provided between the introducing portion (24*d*), and one of the two liquid outlets (24*b*) and one of the two float expansion valves (25), and between the introducing portion (24*d*), and the other liquid outlet (24*b*) and the other float expansion valve (25).

In the fourth invention, the gas-liquid two-phase refrigerant introduced through the introducing portion (24*d*) is separated into a gas refrigerant and a liquid refrigerant, as it strikes the baffle plates (24*e*, 24*f*) while flowing toward the liquid outlets (24*b*) and the float expansion valves (25). Providing the baffle plates (24*e*, 24*f*) between the introducing portion (24*d*) and each float expansion valve (25) reduces or eliminates the possibility that the refrigerant introduced through the introducing portion (24*d*) may be directly sprayed onto the float expansion valves (25).

Incidentally, when the gas refrigerant is sucked through the gas outlet (24*c*), the pressure near the gas outlet (24*c*) becomes lower than that in the remaining region in the tank (24*a*). Thus, if only one gas outlet (24*c*) is provided, there is a large pressure difference between the region near the gas outlet (24*c*) and the remaining region in the tank (24*a*), whereby the level of the liquid refrigerant in the tank (24*a*) rises significantly in the region near the gas outlet (24*c*). This can cause so-called liquid backflow. That is, part of the liquid refrigerant can be sucked through the gas outlet (24*c*) toward the multistage compressor (21).

According to a fifth invention, in the fourth invention, two of the gas outlet (24*c*) are provided, and each gas outlet (24*c*) is positioned closer to the liquid outlet (24*b*) than the baffle plate (24*e*, 24*f*) is in the longitudinal direction of the tank (24*a*).

In the fifth invention, the gas refrigerant is sucked through the two gas outlets (24*b*) rather than through only one gas outlet (24*c*), whereby the suction force of the gas refrigerant by each gas outlet (24*c*) is reduced by half as compared to the case where there is only one gas outlet (24*c*). This reduces the rise of the level of the liquid refrigerant which occurs near the gas outlets (24*c*) due to the suction of the gas refrigerant, and thus reduce or eliminates the possibility of the so-called liquid backflow, namely the possibility that part of the liquid refrigerant may be sucked toward the multistage compressor (21) through the gas outlets (24*c*).

Advantages of the Invention

According to the present invention, since the plurality of float expansion valves (25) are provided, small float expansion valves (25) can be used. This can significantly reduce the unit cost of the float expansion valves (25), whereby the cost can be reduced.

According to the present invention, the plurality of float expansion valves (25) are provided. Thus, even if one of the float expansion valves (25) malfunctions, the remainder of the float expansion valves (25) can decompress the liquid refrigerant, and can control the liquid level in the tank (24*a*). Accordingly, even if any of the float expansion valves (25) malfunctions, the operation of the multistage compression refrigeration system (1) need not be immediately stopped, and can be continued by partial load operation or the like.

According to the second invention, the use of small float expansion valves (25) can significantly reduce the unit cost of the float expansion valves (25). Moreover, providing two float expansion valves (25) can reduce the overall cost of the economizer.

According to the third invention, positioning each float expansion valve (25) with a gap between the float expansion valve (25) and the introducing portion (24*d*) can reduce or eliminate the possibility that the refrigerant introduced through the introducing portion (24*d*) may be directly sprayed onto the float expansion valves (25), and thus can reduce or eliminate the possibility that the introduced refrigerant may affect the operation of the float expansion valves (25).

According to the fourth invention, providing the baffle plates (24*e*, 24*f*) enables the gas-liquid two-phase refrigerant to be reliably, separated into a gas refrigerant and a liquid refrigerant as it strikes the baffle plates (24*e*, 24*f*). Providing the baffle plates (24*e*, 24*f*) can also reduce or eliminate the possibility that the refrigerant introduced through the introducing portion (24*d*) may be directly sprayed onto the float expansion valves (25), and may affect the operation of the float expansion valves (25).

According to the fifth invention, the rise of the level of the liquid refrigerant, which occurs near the gas outlets (24*c*) when the gas refrigerant is sucked through the gas outlets (24*c*), can be reduced. This can reduce or eliminate the possibility of so-called liquid backflow, namely the possibility that part of the liquid refrigerant is sucked toward the multistage compressor (21) through the gas outlets (24*c*).

DESCRIPTION OF REFERENCE CHARACTERS

1 Two-Stage Turbo Refrigeration Machine (Multistage Compression Refrigeration System)
20 Refrigerant Circuit
21 Two-Stage Turbo Compressor (Multistage Compressor)
22 Condenser
23 High Stage Expansion Valve (Multistage Expansion Mechanism)
24 Economizer
24*a* Tank
24*b* Liquid Outlet
24*c* Gas Outlet
24*d* Introducing Portion
24*e* First Partition Wall (Baffle Plate)
24*f* Second Partition Wall (Baffle Plate)
25 Float Expansion Valve (Multistage Expansion Mechanism)
25*a* Valve Disc
25*b* Float
26 Evaporator
28 Gas Pipe

DESCRIPTION OF EMBODIMENTS

An embodiment of the present invention will be, described in detail below with reference to the accompanying drawings. Note that in the present embodiment, a two-stage turbo refrigeration machine having a two-stage turbo compressor is described as a multistage compression refrigeration system using an economizer of the present invention.

Figure 1:
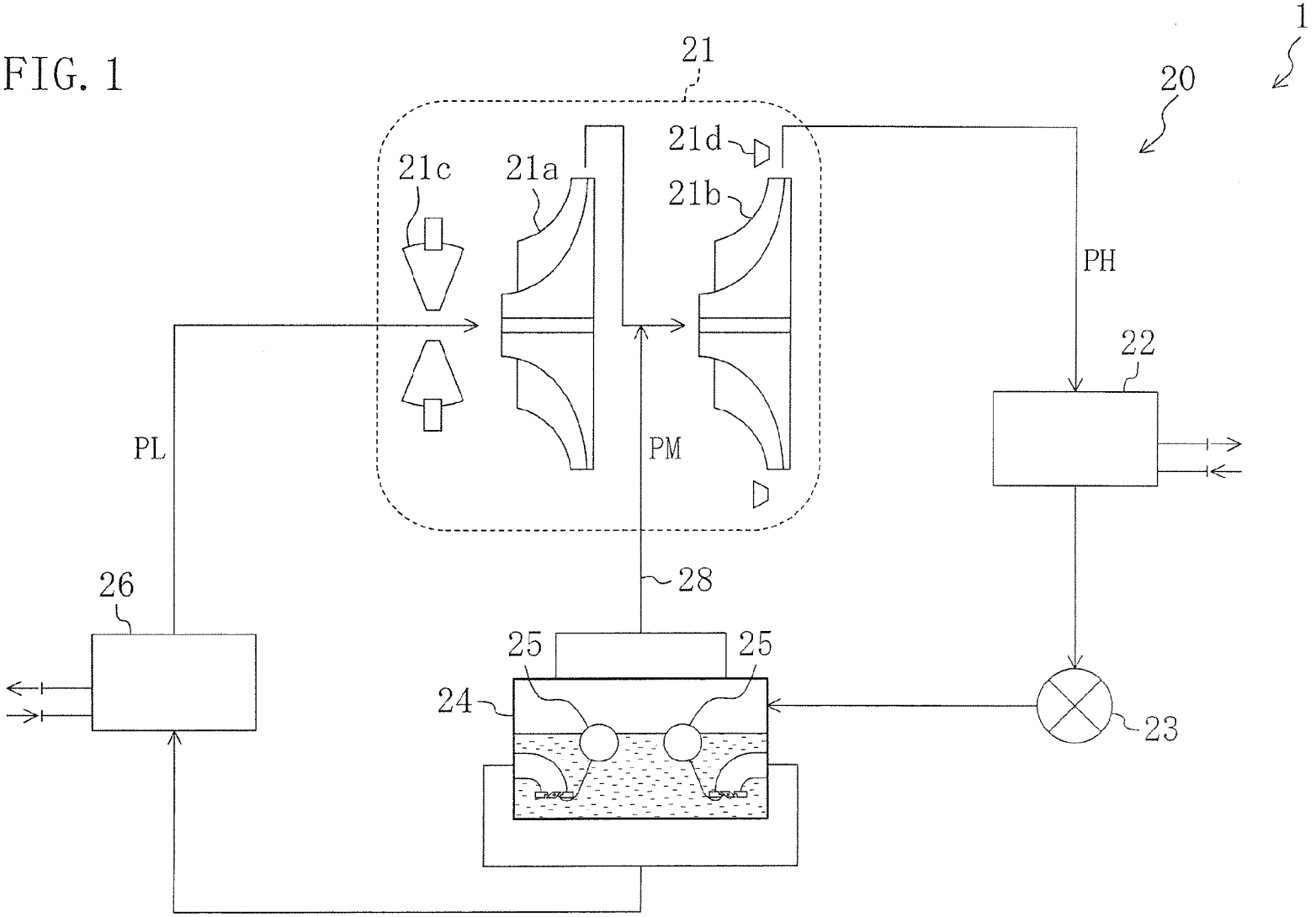
FIG. 1 is a piping diagram showing the general configuration of a multistage turbo refrigeration machine according to an embodiment.

FIG. 1 is a piping diagram schematically showing the configuration of a two-stage turbo refrigeration machine (1) according to an embodiment of the present invention. The two-stage turbo refrigeration machine (1) includes a refrigerant circuit (20) in which a two-stage turbo compressor (21), a condenser, (22), a high stage expansion valve (23), and float expansion valves (25) as low stage expansion valves, and an evaporator (26) are sequentially connected via refrigerant piping to perform a vapor compression refrigeration cycle. An economizer (24) including the float expansion valves (25) is provided between the high stage expansion valve (23) and the evaporator (26) of the refrigerant circuit (20). The high stage expansion valve (23) and the float expansion valves (25) form multistage expansion mechanism.

The two-stage turbo compressor (21) includes a low stage impeller (21*a*) and a high stage impeller (21*b*). The low stage impeller (21*a*) and the high stage impeller (21*b*) are connected in series. The two-stage turbo compressor (21) is provided with a suction capacity control mechanism (21*c*) for controlling suction capacity, and a discharge capacity control mechanism (21*d*) for controlling discharge capacity. The low stage impeller (21*a*) sucks a refrigerant having a low pressure (PL), and compresses the refrigerant to a medium pressure (PM) to supply the compressed refrigerant to the high stage impeller (21*b*). The high stage impeller (21*b*) sucks the refrigerant having the medium pressure (PM), and compresses the medium pressure (PM) refrigerant to a high pressure (PH) to discharge the gas refrigerant having the high pressure (PH).

The condenser (22) is formed by a so-called shell-and-tube condenser having a shell (a cylindrical body) and a plurality of cooling tubes positioned in the shell. The gas refrigerant compressed to the high pressure (PH) in the two-stage turbo compressor (21) is introduced into the shell, where the gas refrigerant is cooled by a coolant that flows in the cooling tubes. Thus, the gas refrigerant condenses outside the cooling tubes into a liquid, which is stored in the shell.

The high stage expansion valve (23) is a temperature sensitive automatic expansion valve for adjusting the amount of decompression according to the degree of superheat of a sucked refrigerant to maintain a constant degree of superheat of the sucked refrigerant. The liquid refrigerant produced in the condenser (22) is decompressed to the medium pressure (PM) by the high stage expansion valve (23), and is then introduced into the economizer (24).

A gas pipe (28), which is connected to a tedium pressure portion of the two-stage turbo compressor (21), is connected to the economizer (24). The economizer (24) separates a gas-liquid two-phase refrigerant into a liquid refrigerant and gas refrigerant. The gas refrigerant having the medium pressure (PM) is guided to the medium pressure portion of the two-stage turbo compressor (21) via the gas pipe (28), while the liquid refrigerant is guided to the evaporator (26).

The float expansion valves (25) are configured to adjust the throttle amount according to the level of the liquid refrigerant in the economizer (24), and are contained in the economizer (24). That is, the economizer (24) decompresses the separated liquid refrigerant by the float expansion valves (25) before guiding the liquid refrigerant toward the evaporator (26).

The evaporator (26) is a flooded evaporator, and in the present embodiment, is a so-called shell-and-tube evaporator. The liquid refrigerant separated in the economizer (24) is decompressed by the floating expansion valves (25), and is then supplied to the evaporator (26). Heat transfer tubes are provided in the shell, and water as a material to be cooled flows in the heat transfer tubes. The liquid refrigerant supplied into the shell absorbs heat from the water in the heat transfer tubes, and evaporates into a gas, which is guided to the suction side of the two-stage turbo compressor (21).

The economizer (24) of the present invention will be described in detail below.

Figure 2:
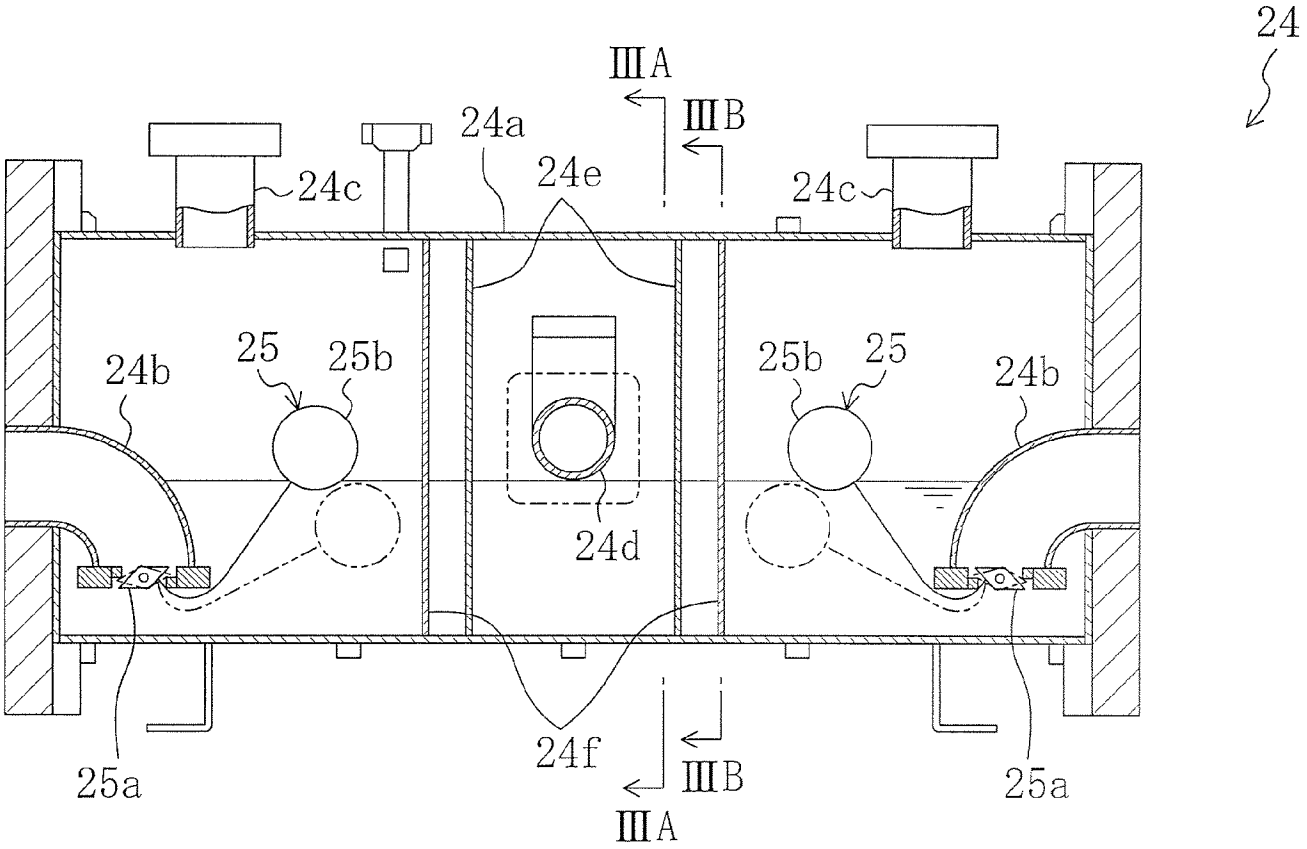
FIG. 2 is a longitudinal section of an economizer.
Figure 3:
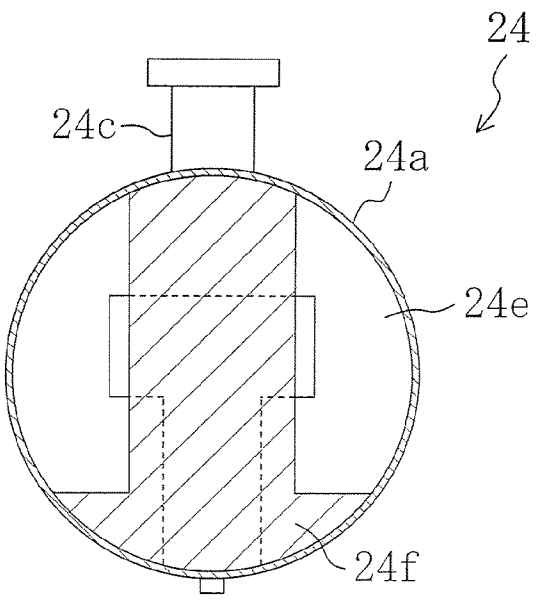
FIG. 3A is a cross-sectional view taken along line IIIA-IIIA in FIG. 2.
FIG. 3B is a cross-sectional view taken along line IIIB-IIIB in FIG. 2.
Figure 3:
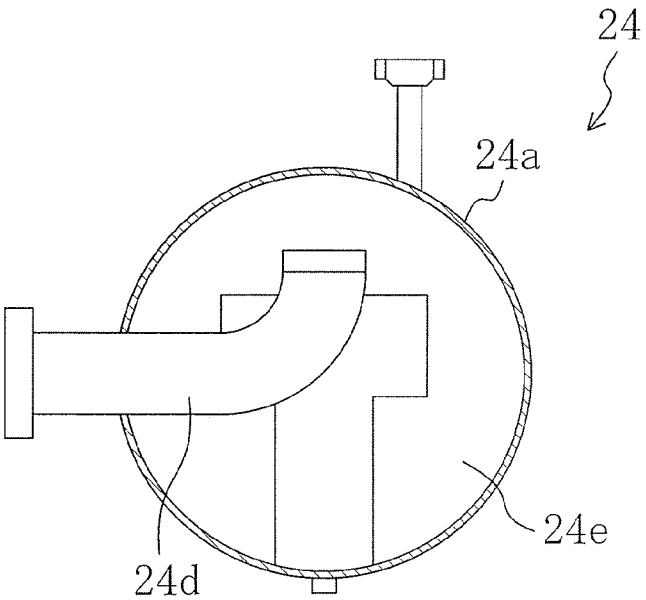

As shown in FIG. 2 and FIGS. 3A-3B, the economizer (24) includes a tank (24*a*) that is longer in the horizontal direction than in the vertical direction. The tank (24*a*) is fainted by a cylindrical body, and closing portions that close both ends of the body. The tank (24*a*) has an introducing portion (24*d*) for introducing the refrigerant of the refrigerant circuit (20) into the tank (24*a*), liquid outlets (24*b*) for guiding the liquid refrigerant in the tank (24*a*) to the evaporator (26), and gas outlets (24*c*) for guiding the gas refrigerant in the tank (24*a*) to the medium pressure portion of the two-stage turbo compressor (21).

The introducing portion (24*d*) is formed in a longitudinal central portion of the tank (24*a*). As shown in FIG. 3A, the introducing portion (24*d*) is formed by a cylindrical member, which extends through a sidewall of the tank (24*a*) and is curved in the tank (24*a*) so as to have an opening facing upward.

As shown in FIG. 2, two liquid outlets (24*b*) are provided in the present embodiment. The two liquid outlets (24*b*) are formed at both longitudinal ends of the tank (24*a*). Each liquid outlet (24*b*) is formed by a cylindrical member, which extends through a sidewall of the tank (24*a*) and is curved in the tank (24*a*) so as to have an opening facing downward.

Two gas outlets (24*c*) are provided in the present embodiment. The two gas outlets (24*c*) are positioned on both sides of the introducing portion (24*d*) in the longitudinal direction of the tank (24*a*), with one gas outlet (24*c*) being located on each side. Each gas outlet (24*c*) is formed by a cylindrical member, which extends from above the tank (24*a*) downward through the upper wall of the tank (24*a*) so that one end of the cylindrical member has an opening in the upper part of the tank (24*a*).

The float expansion valves (25) described above are attached to inlet ends of the liquid outlets (24*b*). More specifically, as shown in FIG. 2, each float expansion valve (25) includes a valve disc (25*a*) that is provided at the inlet end of the liquid outlet (24*b*) formed by the cylindrical member, and a float (25*b*) connected to the valve disc (25*a*). When the float (25*b*) moves upward, the valve disc (25*a*) moves in such a direction that increases the flow of the liquid refrigerant in the liquid outlet (24*b*). When the float (25*b*) moves downward, the valve disc (25*a*) moves in such a direction that decreases the flow of the liquid refrigerant the liquid outlet (24*b*). With this configuration, the throttle amount of the float expansion valve (25) decreases when the liquid level in the tank (24*a*) rises, and the throttle amount of the float expansion valves (25) increases when the liquid level in the tank (24*a*) drops. Thus the float expansion valves (25) control the amount of liquid that flows out of the tank (24*a*), according to the amount of circulation of the refrigerant.

Two kinds of partition walls (24*c*, 24*f*), which extend in the transverse direction of the tank (24*a*), are provided between the introducing portion (24*d*), and the two liquid outlets (24*b*) and the two floating expansion valves (25). As shown in FIG. 3A, each of the first partition walls (24*e*), which are positioned on the introducing portion (24*d*) side, is formed by a substantially circular plate-like member, and has a substantially T-shaped cutout. Each of the second partition walls (24*f*), which are positioned on the liquid outlet (24*b*) side, is formed by a substantially inverted T-shaped plate-like member. The first partition wall (24*e*) and the second partition wall (24*f*) are arranged parallel to each other with a predetermined gap therebetween, thereby forming a baffle plate.

The tank (24*a*) is divided into three spaces by the first partition walls (24*e*) and the second partition walls (240. More specifically, the tank (24*a*) is divided into a central space where the introducing portion (24*d*) is positioned, and side spaces that are located on both sides of the central space, and where the liquid outlets (24*b*) and the float expansion valves (25) are positioned. As shown in FIG. 3B, most of the transverse section of the tank (24*a*) is covered by the first partition wall (24*e*) and the second partition wall (24*f*), when the central space having the introducing portion (24*d*) is viewed from the side space having the liquid outlet (24*b*). This configuration can reduce or eliminate the possibility that the refrigerant introduced through the introducing portion (24*d*) may be directly sprayed onto the floats (25*b*) of the float expansion valves (25).

Note that each of the two gas outlets (24*c*) described above is positioned closer to the liquid outlet (24*b*) than the first partition wall (24*e*) and the second part on wall (24*f*) are. That is, of the three spaces of the tank (24*a*) separated by the first partition walls (24*e*) and the second partition walls (24*f*), the gas outlets (24*e*) are provided in the side spaces where the liquid outlets (24*b*) are provided, rather than in the central space where the introducing portion (24*d*) is provided. Positioning the gas outlets (24*c*) in the side spaces can reduce or eliminate the possibility that the gas-liquid two-phase refrigerant introduced through the introducing portion (24*d*) may be directly sucked by the gas outlets (24*c*).

The operation of the two-stage turbo refrigeration machine (1) will be described below.

First, when the operation of the two-stage turbo refrigeration machine (1) is started, the low stage and high stage impellers (21*a*, 21*b*) of the two-stage turbo compressor (21) rotate, and the refrigerant having the low pressure (PL) in the refrigerant circuit (20) is sucked from the low stage side. At this time, the refrigerant suction capacity is adjusted by the suction capacity control mechanism (21*c*). The low pressure (PL) refrigerant sucked by the low stage impeller (21*a*) is compressed to the medium pressure (PM), and is then supplied to the high stage impeller (21*b*). The high stage impeller (21*b*) compresses the medium pressure (PM) refrigerant into a gas refrigerant having a high pressure (PH), and discharges the high pressure (PH) gas refrigerant to the refrigerant circuit (20). At this time, the refrigerant discharge capacity is adjusted by the discharge capacity control mechanism (21*d*).

The high pressure (PH) refrigerant discharged from the two-stage turbo compressor (21) to the refrigerant circuit (20) is cooled to condense in the condenser (22). The liquid refrigerant thus produced is decompressed to the medium pressure (PM) by the high stage expansion valve (23), and is then introduced into the economizer (24). Note that the amount of decompression of the high stage expansion valve (23) is adjusted according to the degree of superheat of the sucked refrigerant. Thus, the amount of circulation of the refrigerant is controlled so as to maintain a predetermined degree of superheat of the sucked refrigerant.

The gas-liquid two-phase refrigerant introduced into the tank (24*a*) of the economizer (24) is separated into a liquid refrigerant and a gas refrigerant. The gas refrigerant is guided to the medium pressure portion of the two-stage turbo compressor (21) via the gas pipe (28), while the liquid refrigerant is guided to the evaporator (26).

The medium pressure (PM) gas refrigerant thus guided to the medium pressure portion of the two-stage turbo compressor (21) is mixed with the medium pressure (PM) refrigerant compressed by the low stage impeller (21*a*) of the two-stage turbo compressor (21). The mixed refrigerant flows into the high stage impeller (21*b*) and is compressed therein.

On the other hand, the liquid refrigerant, which is to be guided to the evaporator (26), is decompressed to the low pressure (PL) by the float expansion valves (25) in the liquid outlets (24*b*) when flowing through the liquid outlets (24*b*) toward the evaporator (26). The low pressure (PL) refrigerant is then supplied to the evaporator (26).

The low pressure (PL) refrigerant, which has been decompressed by the float expansion valves (25) and supplied to the evaporator (26) in this manner, absorbs heat from the water in the heat transfer tubes to evaporate, and the gas refrigerant thus produced is guided to the suction side of the two-stage turbo compressor (21). This gas refrigerant is then compressed by the two-stage turbo compressor (21).

The operation of the economizer (24) will be described in detail below.

After being introduced through the introducing portion (24*d*) into the central space in the tank (24*a*), the refrigerant flows out of the central space into the side spaces located on both sides of the central space in the tank (24*a*). At this time, the refrigerant is separated into a liquid refrigerant and a gas refrigerant as it strikes the partition walls (24*e*, 24*f*) and the inner wall surface of the tank (24*a*). The liquid refrigerant thus separated runs down the partition walls (24*e*, 24*f*) and the inner wall surface of the tank (24*a*) to the bottom of the tank (24*a*). On the other hand, the gas refrigerant flows through the partition walls (24*e*, 24*f*) into the side spaces where the liquid outlets (24*b*) are positioned.

The liquid refrigerant flows into the evaporator (26) through the liquid outlets (24*b*) in the side spaces of the tank (24*a*). At this time, the flow of the liquid refrigerant in each liquid outlet (24*b*) is reduced by the valve disc (25*a*) of the float expansion valve (25). Thus, the liquid refrigerant is decompressed by the flow expansion valve (25).

The throttle amount of each float expansion valve (25) is adjusted according to the level of the liquid refrigerant in the tank (24*a*). That is, as the liquid level rises, the float (25*b*) moves upward, and the valve disc (25*a*) moves in such a direction that increases the flow of the liquid refrigerant in the liquid outlet (24*b*). This reduces the throttle amount, and increases the amount of the liquid refrigerant that flows out of the tank (24*a*), whereby the liquid level rises at a reduced rate, or the liquid level drops. If the liquid level drops, the float (25*b*) moves downward, and the valve disc (25*a*) moves in such a direction that reduces the flow of the liquid refrigerant in the liquid outlet (24*b*). This increases the throttle amount, and reduces the amount of the liquid refrigerant that flows out of the tank (24*a*), whereby the liquid level drops at a reduced rate, or the liquid level rises. In this manner, the level of the liquid refrigerant in the tank (24*a*) is controlled by the throttle amount of the float expansion valves (25) that is adjusted according to the amount of circulation of the refrigerant.

On the other hand, the gas refrigerant is sucked into the medium pressure portion of the two-stage turbo compressor (21) through the gas outlets (24*c*) in the side spaces where the liquid outlets (24*b*) are positioned. Since two gas outlets (24*c*) are provided, the gas refrigerant is sucked into the medium pressure portion through the two gas outlets (24*c*) rather than through only one gas outlet (24*c*). Thus, when the gas refrigerant is sucked into the medium pressure portion through the gas outlets (24*c*), the pressure near the gas outlets (24*c*) becomes lower than that in the remaining regio in the tank (24*a*). However, the pressure difference between the region near each gas outlet (24*c*) and the remaining region in the tank (24*a*) can be reduced as compared to the case where there is only one gas outlet (24*c*). Thus, even if the liquid refrigerant is sucked toward the gas outlets (24*c*), and the level of the liquid refrigerant rises under the gas outlets (24*c*), the rise of the level of the liquid refrigerant can be reduced. This can reduce the possibility that the liquid refrigerant may be sucked together with the gas refrigerant by the gas outlets (24*c*).

Advantages of the Embodiment

As described above, the economizer (24) of the present embodiment is provided with two liquid outlets (24*b*) and two float expansion valves (25), while conventional economizers are provided with only one liquid outlet and one float expansion valve. Thus, the liquid refrigerant flows out of the tank (24*a*) through the two liquid outlets (24*b*), ant the amount of the liquid refrigerant that flows out of the tank (24*a*) is controlled by the two float expansion valves (25). This reduces the amount of control required for each float expansion valve (25), as compared to the case where the amount of the liquid refrigerant that flows out of the tank (24*a*) is controlled by one float expansion valve (25). This enables the economizer (24) to use small float expansion valves (25), whereby the unit cost of the float expansion valves (25) can be significantly reduced. Thus, the cost of the economizer (24) can be reduced.

The economizer (24) is provided with two float expansion valves (25). Thus, even if one of the float expansion valves (25) malfunctions, the other float expansion valve (25) can decompress the liquid refrigerant, and can control the liquid level in the tank (24*a*). Thus, even if one of the float expansion valves (25) malfunctions, the operation of the two-stage turbo refrigeration machine (1) need not be immediately stopped, and can be continued by partial load operation or the like.

Note that although two liquid outlets (24*b*) and two float expansion valves (25) are provided in the present embodiment, three or more liquid outlets (24*b*) and three or more float expansion valves (25) may be provided. In this case as well, the float expansion valves (25) can be reduced in size, and the economizer (24) can be manufactured inexpensively. However, providing two float expansion valves (25) as the present embodiment can reduce the size of the float expansion valves (25), and thus significantly reduce the unit cost of the float expansion valves (25), whereby the cost of the economizer (24) can further be reduced.

In the economizer (24), the float expansion valves (25) are positioned on both sides of the introducing portion (24*d*) in the longitudinal direction of the tank (24*a*). Thus, a gap is interposed between each float expansion valve (25) and the introducing portion (24*d*). This can reduce or eliminate the possibility that the refrigerant introduced through the introducing portion (24*d*) may be sprayed onto the floats (25*b*) of the float expansion valves (25), and thus can reduce or eliminate the possibility that the introduced refrigerant may affect the operation of the float expansion valves (25).

In the economizer (24), the partition walls (24*e*, 24*f*), each formed by a plate-like member extending in the transverse direction of the tank (24*a*), are provided between the introducing portion (24*d*), and the two liquid outlets (24*b*) and the two float expansion valves (25). Providing the partition walls in this manner enables the gas-liquid two-phase refrigerant to be separated into a gas refrigerant and a liquid refrigerant, and also can reduce or eliminate the possibility that the refrigerant introduced through the introducing portion (24*d*) may be directly sprayed onto the floats (25*b*) of the float expansion valves (25), and may affect the operation of the float expansion valves (25).

Incidentally, when the gas refrigerant is sucked through the gas outlets (24*c*), the pressure near the gas outlets (24*c*) becomes lower than that in the remaining region in the tank (24*a*). Thus, if only one gas outlet (24*c*) is provided, there is a large pressure difference between the region near the gas outlet (24*c*) and the remaining region in the tank (24*a*), whereby the level of the liquid refrigerant in the tank (24*a*) rises significantly in the region near the gas outlet (24*c*). This can cause so-called liquid backflow. That is, part of the liquid refrigerant can be sucked through the gas outlet (24*c*) into the two-stage compressor (21).

However, the economizer (24) is provided with two gas outlets (24*c*), and the gas outlets (24*c*) are positioned on both sides of the introducing portion (24*d*) in the longitudinal direction of the tank (24*a*), with one gas outlet (24*c*) being located on each side. Thus, the gas refrigerant is sucked through the two gas outlets (24*c*) rather than through only one gas outlet (24*c*), whereby the suction force of the gas refrigerant by each gas outlet (24*c*) is reduced by half as compared to the case where there is only one gas outlet (24*c*). This can reduce the rise of the level of the liquid refrigerant which occurs near the gas outlets (24*c*) due to the suction of the gas refrigerant, and thus can reduce or eliminate the possibility of the so-called liquid backflow, namely the possibility that part of the liquid refrigerant may be sucked into the two-stage turbo compressor (21) through the gas outlets (24*c*).

Other Embodiments

Although two liquid outlets (24*b*) and two float expansion valves (25) are provided in the above embodiment, three or more, liquid outlets (24*b*) and three or more float expansion valves (25) may be provided. In this case as well, the size of the float expansion valves (25) can be reduced, and the economizer (24) can be manufactured inexpensively.

Although the introducing portion (24*d*), the liquid outlets (24*b*), and the gas outlets (24*c*) are formed by cylindrical members in the above embodiment, the introducing portion (24*d*), the liquid outlets (24*b*), and the gas outlets (24*c*) may be formed by simple openings.

Although a two-stage compression, two-stage expansion refrigeration system is described in the above embodiment as the multistage compression refrigeration system including the economizer (24) of the present invention, the present invention may be applied to multistage compression refrigeration systems such as to three-stage compression, three-stage expansion refrigeration system. In this case, a plural of economizers are arranged in series.

Note that the above embodiments are essentially preferable examples, and are not intended to limit the scope of the present invention, is applications, or its uses.

INDUSTRIAL APPLICABILITY

As described above, the present invention is useful for turbo refrigeration machines.

The invention claimed is:

1. An economizer, which is provided in a multistage compression refrigeration system including a refrigerant circuit in which a multistage compressor, a condenser, a multistage expansion mechanism, and an evaporator are sequentially connected, and which separates a gas-liquid two-phase refrigerant into a gas refrigerant and a liquid refrigerant to guide the gas refrigerant into a medium pressure portion of the multistage compressor, and to guide the liquid refrigerant to the evaporator, comprising:

a tank having an introducing portion for introducing the gas-liquid two-phase refrigerant of the refrigerant circuit, a liquid outlet for guiding the liquid refrigerant into the evaporator, and a gas outlet for guiding the gas refrigerant into the medium pressure portion of the multistage compressor; and a float expansion valve, which forms part of the multistage expansion mechanism, and is attached to the liquid outlet to adjust a throttle amount according to a level of the liquid refrigerant in the tank, wherein at least two liquid outlets and at least two float expansion valves are provided, the tank is longer in a horizontal direction than in a vertical direction, the introducing portion is formed in a longitudinal central portion of the tank, and the liquid outlets and the float expansion valves are positioned on both sides of the introducing portion in a longitudinal direction of the tank, with one liquid outlet and one float expansion valve being located on each side, an inside of the tank is provided with baffle plates extending in a transverse direction of the tank, provided between the introducing portion, and one of the liquid outlets and one of the float expansion valves, and between the introducing portion, and another one of the liquid outlets and another one of the float expansion valves, and forming partition walls partitioning the tank into a central space where the introducing portion is positioned and side spaces where the liquid outlets are positioned, with one liquid outlet being located in each side space, such that the liquid refrigerant flows from the central space to the side spaces, two of the gas outlet are provided, and each of the gas outlets is positioned in each of the side spaces in a longitudinal direction of the tank, each of the baffle plates includes first and second partition walls provided in the longitudinal direction of the tank at a predetermined interval therebetween, and extending in the transverse direction of the tank, and in each of the baffle plates the first and second partition walls include respective cutouts in positions different from one another when viewed from the side space toward the central space.

2. The economizer of claim 1, wherein in each of the baffle plates, the first partition wall is positioned on the introducing portion side, the second partition wall is positioned on the liquid outlet side, and the cutout of the first partition wall is positioned below an outlet end of the introducing portion when viewed from the side space toward the central space.

* * * * *